US010336129B2

(12) United States Patent
Nakajima et al.

(10) Patent No.: US 10,336,129 B2
(45) Date of Patent: Jul. 2, 2019

(54) WRITING IMPLEMENT

(71) Applicant: MITSUBISHI PENCIL COMPANY, LIMITED, Shinagawa-ku, Tokyo (JP)

(72) Inventors: Tooru Nakajima, Yokohama (JP); Takeo Fukumoto, Yokohama (JP); Kazuhiko Furukawa, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 125 days.

(21) Appl. No.: 15/322,418

(22) PCT Filed: Jul. 2, 2015

(86) PCT No.: PCT/JP2015/069204

§ 371 (c)(1),
(2) Date: Dec. 27, 2016

(87) PCT Pub. No.: WO2016/002908

PCT Pub. Date: Jan. 7, 2016

(65) Prior Publication Data

US 2017/0144472 A1 May 25, 2017

(30) Foreign Application Priority Data

Jul. 3, 2014 (JP) ..... 2014-137523

(51) Int. Cl.
*B43K 8/00* (2006.01)
*B43K 8/02* (2006.01)
(Continued)

(52) U.S. Cl.
CPC ..... *B43K 8/02* (2013.01); *B43K 1/12* (2013.01); *B43K 5/00* (2013.01); *B43K 8/026* (2013.01); *B43K 17/005* (2013.01)

(58) Field of Classification Search
CPC ..... B43K 1/003; B43K 1/006; B43K 1/12; B43K 8/02; B43K 8/022; B43K 8/024; B43K 8/026; B43K 8/028
(Continued)

(56) References Cited

U.S. PATENT DOCUMENTS 5,026,189 A 6/1991 Keil
7,237,970 B2 * 7/2007 Bolton ..... B43K 17/005 401/198
2004/0161282 A1 8/2004 Bolton

FOREIGN PATENT DOCUMENTS

CN 86103382 A 11/1987
EP 0395973 A1 11/1990
(Continued)

OTHER PUBLICATIONS

Supplementary European Search Report issued in corresponding International Application No. PCT/JP2015/069204, dated Jan. 26, 2018, 6 pages.
(Continued)

*Primary Examiner* — David J Walczak
*Assistant Examiner* — Joshua R Wiljanen
(74) *Attorney, Agent, or Firm* — Quarles & Brady LLP

(57) ABSTRACT

Lines can be freely varied in thickness, and lines with characteristics such as "stops", "flicks", and "sweeping strokes" can be written easily, even with a felt-tip pen, marker pen, or the like. Moreover, a pen-tip does not readily become damaged or worn. A writing implement includes a shaft, an ink supply core such as that of a felt-tip pen or a marker pen, and a core surrounding member that covers the ink supply core. The writing implement is formed capable of contacting a tip of the ink supply core and a tip of the core surrounding member against a writing surface at the same time by using a joint capable of changing a relative posi-
(Continued)

tional relationship between the ink supply core and the core surrounding member.

4 Claims, 4 Drawing Sheets

(51) Int. Cl.
*B43K 5/00* (2006.01)
*B43K 17/00* (2006.01)
*B43K 1/12* (2006.01)

(58) Field of Classification Search
USPC ..... 401/146, 148, 198, 205, 206
See application file for complete search history.

(56) References Cited

FOREIGN PATENT DOCUMENTS

| | | | |
|---|---|---|---|
| GB | 2116915 | A | 10/1983 |
| JP | H02-303896 | A | 12/1990 |
| JP | H08-034195 | A | 2/1996 |
| JP | 2004-520205 | A | 7/2004 |
| JP | 2013-252655 | A | 12/2013 |
| WO | 02064379 | A1 | 8/2002 |

OTHER PUBLICATIONS

Second Office Action issued in corresponding Chinese Patent Application No. 201580035016.9, dated May 30, 2018, 5 pages.

* cited by examiner

WRITING IMPLEMENT

CROSS REFERENCE TO RELATED APPLICATIONS

The present application is the U.S. national phase of PCT Application No. PCT/JP2015/069204 filed on Jul. 2, 2015, which claims the priority of a Japanese patent application No. 2014-137523 filed in Japan on Jul. 3, 2014, both disclosures of which are incorporated in their entirety by reference herein.

TECHNICAL FIELD

The present invention relates to a felt-tip pen, a marker pen, or the like that is capable of writing with a variable line width.

BACKGROUND

Ballpoint pens exist that, in order to enable writing with line widths of varying thicknesses, are formed capable of front-rear displacement of the relative positions of a holder, this being part of a ballpoint pen-tip, and an outer member that covers the outer periphery of the ballpoint pen-tip, to a holder retracted position covering as far as a portion where a tip of the outer member reaches a compression deformed swaged section at a leading end of the holder. Note that when the relative positions of the outer member and the holder are at the holder retracted position, a writing ball and the tip of the outer member are capable of contacting a writing surface at the same time. Patent Document 1 below describes an example of such technology.

Patent Document 1: JPA 2013-252655

SUMMARY

Technical Problem

However, the invention of Patent Document 1 relates to a ballpoint pen, and the thickness of the line that can be written is limited. The present invention provides a writing implement such as a felt-tip pen or marker pen for writing characters with thick lines that cannot be achieved using a ballpoint pen. The writing implement includes a pen tip that enables the width of a line to be freely varied, enables lines with characteristics such as "stops", "flicks", and "sweeping strokes" to be written easily, and is less susceptible to damage and wear than the pen tips of existing felt-tip pens, markers, and the like.

Solution to Problem

In order to address the above issue, the present invention includes configurations such as the following.

First Aspect

A first aspect of the present invention is a writing implement including: a shaft; an ink supply core, such as that of a felt-tip pen or marker pen, that is housed inside the shaft, and that is capable of guiding ink by capillary force; a core surrounding member that covers an outer periphery of the ink supply core such that a portion of the ink supply core and a portion of the core surrounding member are exposed at a leading end of the shaft; and a joint that is capable of changing a relative positional relationship between the ink supply core and the core surrounding member in an axial direction. The writing implement is formed such that the ink supply core is moved by the joint relatively rearward with respect to the core surrounding member so as to enable a tip of the ink supply core and a tip of the core surrounding member to contact a writing surface at the same time.

The shaft is an outer section structure of the writing implement, has a closed rear end, and has a tapered profile at a leading end. An opening is present in a leading end face of the shaft. Ink is stored inside the shaft. There is no particular limitation to the manner in which this is achieved, and ink may be stored inside the shaft directly, or an ink refill filled with ink may be stored inside the shaft.

The ink supply core is formed by extrusion molding a resin material such as polyacetal. During extrusion molding, a path is formed that guides ink to the tip of the ink supply core by capillary action. Moreover, the ink supply core may be a fiber core, a sintered core, or the like.

The core surrounding member is a substantially conical shaped member that covers at least the ink supply core exposed from the shaft, and is preferably formed from a resin material such as polyacetal.

The joint is a means to enable the relative positional relationship between the ink supply core and the core surrounding member to be changed. The joint encompasses both displacement of the ink supply core in cases in which the ink supply core is formed so as to be capable of moving with respect to the core surrounding member, and displacement of the core surrounding member in cases in which the core surrounding member is formed so as to be capable of moving with respect to the ink supply core.

In the writing implement of the present aspect, when the relative positional relationship between the ink supply core and the core surrounding member is changed by the joint such that the ink supply core projects out from the tip of the core surrounding member, only the tip of the ink supply core contacts the writing surface, enabling a line to be drawn at the thickness capable of being written using the surface of the ink supply core.

However, when writing is started in a state in which the relative positional relationship between the ink supply core and the core surrounding member has been changed by the joint such that the ink supply core has moved rearward relative to the core surrounding member, and the tip of the ink supply core and the tip of the core surrounding member are in contact with the writing surface at the same time, the ink held by the ink supply core flows out accompanying writing. The ink that has flowed out spreads due to capillary action between the tip of the ink supply core and the tip of the core surrounding member that are in contact with the writing surface. As a result, a broader line can be drawn than when writing in a state in which only the tip of the ink supply core is in contact with the writing surface.

Moreover, when writing with the tip of the ink supply core and the tip of the core surrounding member in contact with the writing surface at the same time due to the joint, writing pressure applied during writing is borne mainly by the core surrounding member, enabling the writing pressure placed on the ink supply core that holds the ink to be reduced. This thereby enables wear of the pen tip of the ink supply core to be reduced.

Second Aspect

A second aspect of the present invention is the first aspect, wherein the joint is an elastic member disposed at a rear of the ink supply core, and the relative positional relationship between the ink supply core and the core surrounding member can be changed by compression of the elastic member. The writing implement is formed such that the ink supply core is formed so as to be able to move rearward relative to the core surrounding member, from an initial position that is a portion of the ink supply core that is exposed from the core surrounding member, by the elastic member being compressed with load applied to the tip of the ink supply core.

The present aspect specifies the joint of the first aspect.

The joint is capable of changing the relative positional relationship between the ink supply core and the core surrounding member between a position where the ink supply core has been moved rearward relative to the core surrounding member (referred to below as the "retracted position"), and a position where the ink supply core projects out from the tip of the core surrounding member (referred to below as the "projecting position").

The elastic member serving as the joint is formed from an elastic material, such as rubber or a spring. This thereby enables the elastic member to return to its initial shape under the elastic action of the elastic member when in a compressed shape.

In the present aspect, the ink supply core is formed capable of undergoing displacement with respect to the shaft and the core surrounding member. Note that when writing load from the direction of the tip acts on the ink supply core, the ink supply core moves relatively rearward with respect to the core surrounding member. When the writing load acting on the ink supply core is lifted, the elastic member returns to its initial shape under elastic action, accompanying which the ink supply core also returns to the projecting position.

Due to the above configuration, the present aspect enables lines of different thicknesses to be drawn by varying the writing load. Moreover, configuring the elastic member from a soft member with a low modulus of elasticity enables thick lines to be drawn irrespective of the writing load, and at any angle, by those with weaker strength, such as the elderly or small children.

Moreover, if the load required to move from the projecting position to the retracted position is very small in comparison to the writing load, the ink supply core can be displaced to the retracted position to enable thick lines to be drawn consistently, without writing becoming uncomfortable. Moreover, when the writing load is lightened due to separation of the writing section from the writing surface in an action to produce a "stop" or "sweeping stroke", for example, the ink supply core is displaced from the retracted position toward the projecting position in a continuous manner, thus giving a continuous and smooth transition in the width of the writing from a broad line to a thin line.

Moreover, due to the shape of the elastic member, a change in internal volume accompanying deformation of the elastic member can be utilized, such that an ink flow path is placed in a pressurized state by the writing load to give a good ink flow rate at the start of writing.

Third Aspect

A third aspect of the present invention is the first or the second aspect, wherein an ink supply space including a gap exhibiting capillary force is formed at an inside of the ink supply core, and ink is guided by the capillary force of the ink supply space.

The present aspect specifies the location at which capillary force is exhibited in the ink supply core of the first or the second aspect.

The ink supply space in the third aspect is formed by extrusion molding of the ink supply core so that finely controlled paths are left inside the ink supply core. These paths are employed to guide ink.

Fourth Aspect

A fourth aspect of the present invention is the first or the second aspect, wherein an ink supply space including a gap exhibiting capillary force is formed at an outside of the ink supply core, and ink is guided by the capillary force of the ink supply space.

The present aspect specifies the location at which capillary force is exhibited in the ink supply core of the first or the second aspect.

The ink supply space in the fourth aspect is formed by extrusion molding of the ink supply core so that finely controlled paths are left at the outside of the ink supply core. These paths are employed to guide ink.

Advantageous Effects of Invention

Due to the above configuration, the present invention enables lines of varying thickness to be drawn freely employing the joint, and enables actions such as "stops", "flicks", and "sweeping strokes" to be reproduced easily and with high quality even with a felt-tip pen, marker pen, or the like. Moreover, writing pressure when writing is borne mainly by the core surrounding member, thereby enabling damage to the ink supply core, serving as the pen-tip, to be prevented, and enabling wear to be reduced. Moreover, since there are no holes on the surface of the core surrounding member, unlike in the ink supply core, catching on a paper surface is reduced, enabling a smooth writing sensation.

DETAILED DESCRIPTION

Explanation follows with reference to the drawings regarding an example of a felt-tip pen or a marker pen, serving as a writing implement 1 according to an exemplary embodiment of the present invention, in which a writing section is provided at a leading end of a shaft 10. Note that in the present invention, the "front" of the writing implement 1 and its configuration components refers to the direction in which the writing section is provided, and the "rear" refers to the opposite direction thereto.

Overall Configuration

Figure 1A:
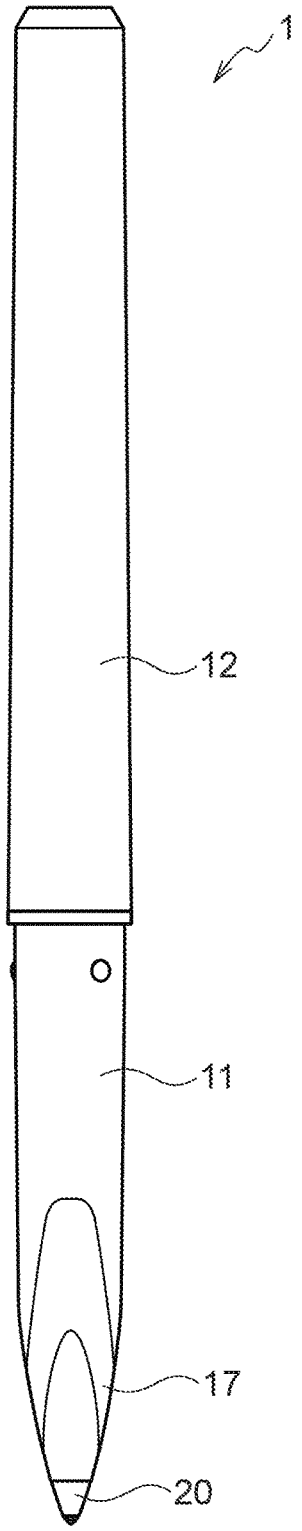
FIG. 1A is a front view.
Figure 1B:
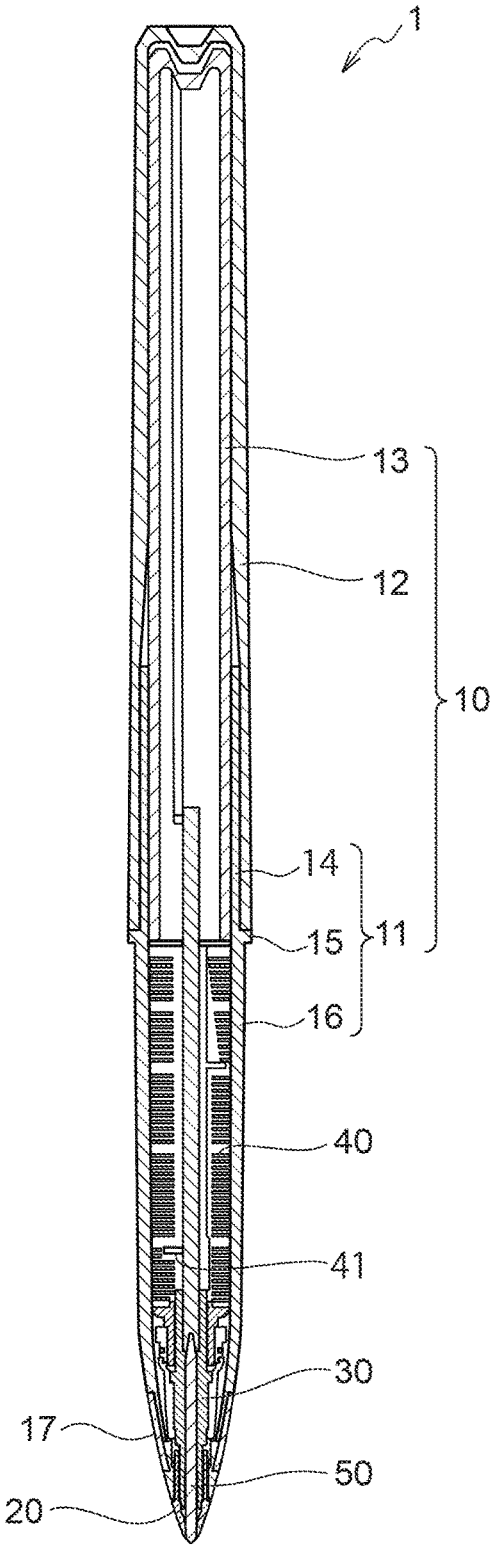
FIG. 1B is a front cross-section, of a writing implement according to an exemplary embodiment of the present invention.

As illustrated in FIG. 1A, an external profile of the writing implement 1 according to the exemplary embodiment of the present invention includes the shaft 10 that is provided with a tip shaft 11 and a rear shaft 12, and an outer member 20, serving as a core surrounding member 20, fixed to the front side of the tip shaft 11 serving as the writing section. As illustrated in FIG. 1B, an ink supply core 50, serving as the writing section, is housed inside the shaft 10 spanning from the front side of the tip shaft 11 to a leading end of the outer member 20.

Structure of the Shaft 10

As illustrated in FIG. 1B, the structure of the writing implement 1 according to the exemplary embodiment of the present invention is configured by a cylindrical shaped ink tank 13 having a closed rear end, the tip shaft 11, that has a cylindrical shape with a tapered profile at a leading end, and with a leading end of the ink tank 13 fitted into the inner periphery of the rear end of the tip shaft 11, and the cylindrical shaped rear shaft 12 having a closed rear end and having the rear end of the tip shaft 11 fitted into the inner periphery of the leading end of the rear shaft 12.

As illustrated in FIG. 1B, the tip shaft 11 has a substantially cylindrical shape, and has a tapered profile at its leading end. The outer periphery of the tip shaft 11 is provided with a tip shaft flange 15 at a position approximately ⅓ of the way from the rear end of the tip shaft 11. The tip shaft flange 15 has an outer diameter that is substantially the same diameter as the outer diameter of the rear shaft 12, and the leading end of the rear shaft 12 abuts the tip shaft flange 15. The tip shaft 11 includes, on each side of a boundary of the tip shaft flange 15, a substantially cylindrical tube shaped tip shaft rear portion 14 toward the rear side, and a tip shaft front portion 16 with a tapered profile toward the front side.

Figure 2:
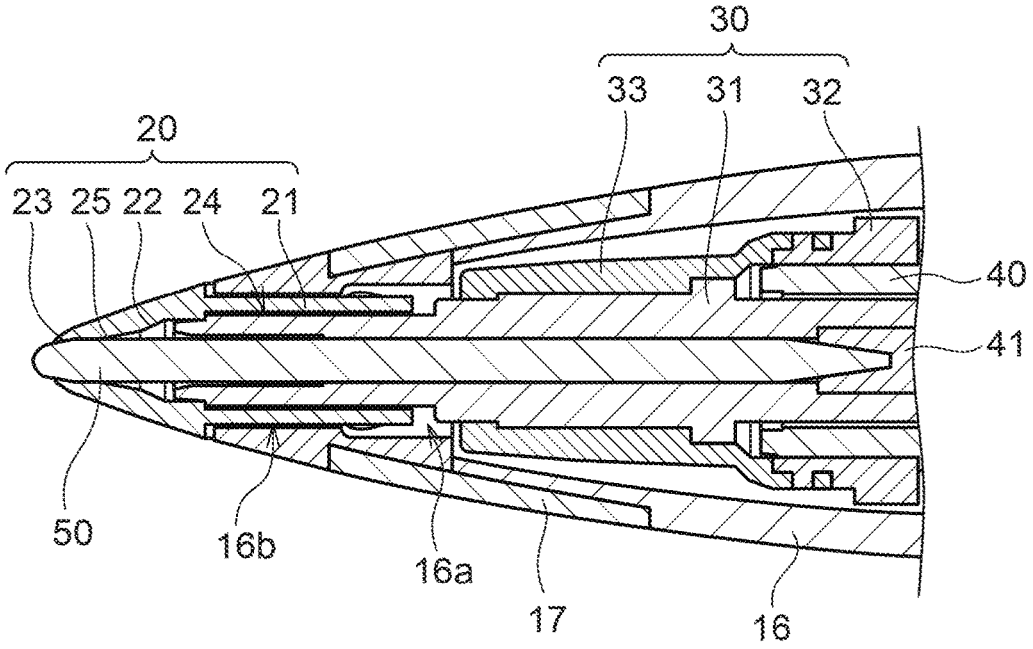
FIG. 2 is an enlarged cross-section of a front side of a writing implement according to an exemplary embodiment of the present invention, when at a projecting position.

As illustrated in FIG. 2, a leading end portion of the tip shaft front portion 16 is provided with a tip shaft front reduced diameter hole 16*a* having a reduced diameter, into which a leading end of a joint 30 is inserted, and an outer member insertion hole 16*b* is contiguously provided to the front of the tip shaft front reduced diameter hole 16*a* and has the outer member 20 inserted therein. A groove is provided on the outer periphery of the tip shaft front portion 16 in the vicinity of the leading end thereof, so as to enable mounting of another member, and an anti-slip grip member 17 is mounted in the groove.

Internal Structure of the Tip Shaft 11

As illustrated in FIG. 1B, a collector 40 made from an ABS resin is press-fitted inside the tip shaft front portion 16. In the collector 40, plural plate shaped members are disposed running parallel to the axial direction. Ink, not illustrated in the drawings, can be held between the plate shaped members. Moreover, a collector core 41, formed from a bundle of fibers, runs through the axial center of the collector 40. The joint 30 is mounted at the front side of the tip shaft 11, namely in front of the collector 40.

Overall Structure of the Joint 30

Figure 3C:
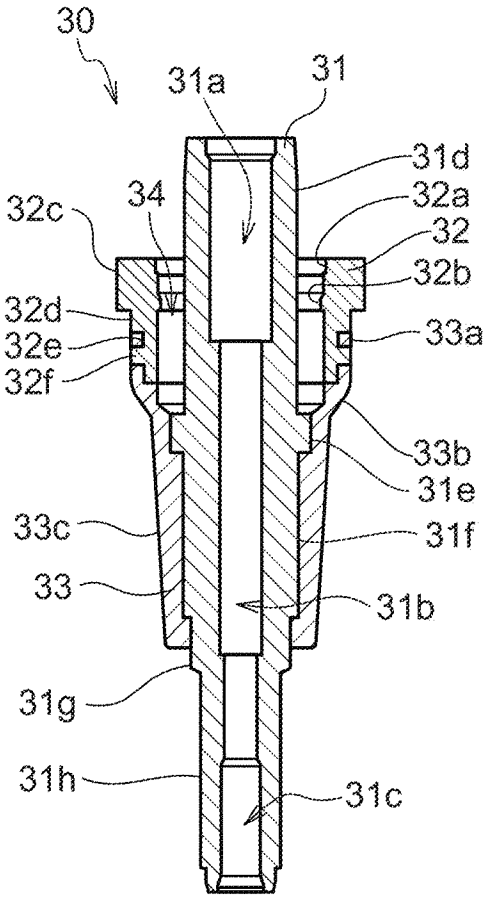
FIG. 3C is a vertical cross-section, of a joint of a writing implement according to an exemplary embodiment of the present invention.
Figure 3B:
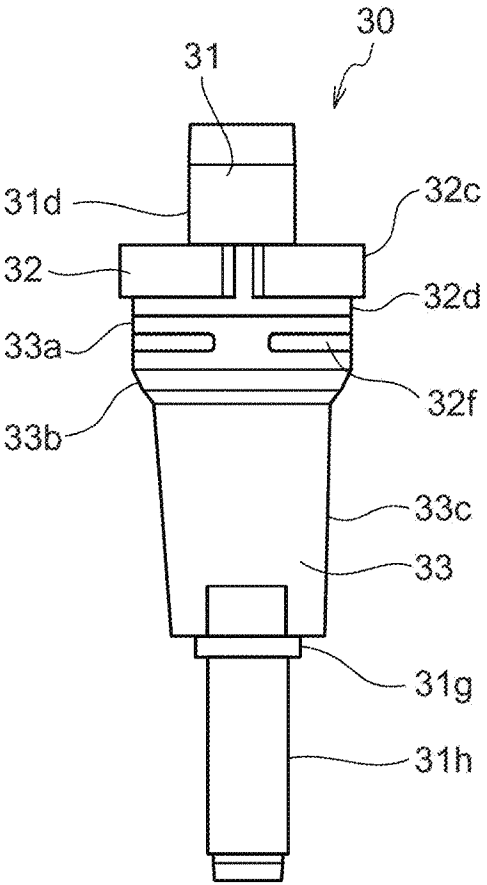
FIG. 3B is a front view.
Figure 3A:
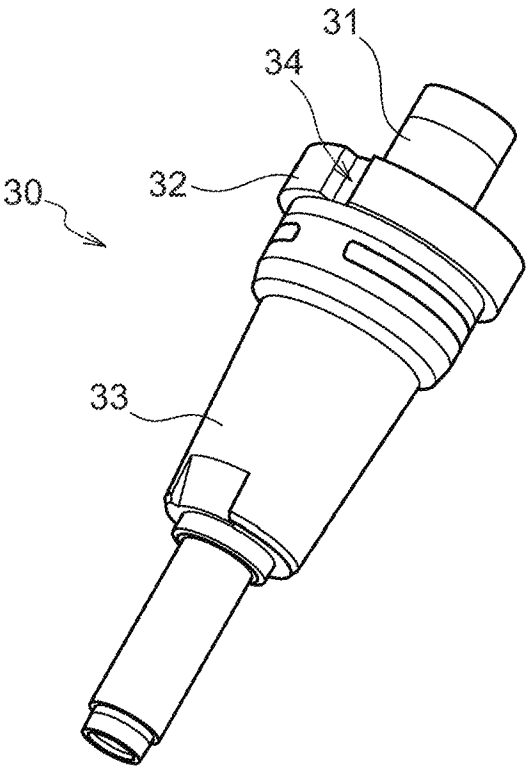
FIG. 3A is a perspective view.

As illustrated in FIG. 3A, the joint 30 is configured from a substantially cylindrical shaped center member 31, a substantially cylindrical shaped surrounding member 32 formed from approximately ¼ from the rear end of the center member 31 to approximately ⅓ from the rear end of the center member 31, such that gap sections 34 of the thickness of the leading end of the collector 40 are present at the outer periphery of the rear of the center member 31, and an interposing member 33 formed so as to cover the center member 31 from a leading end of the surrounding member 32 to a position approximately ⅓ back from a leading end of the center member 31.

Center Member 31

As illustrated in FIG. 2, the collector core 41 is inserted into the center member 31 from the rear, and the ink supply core 50 is inserted into the center member 31 from the front.

As illustrated in FIG. 3C, at the inner periphery of the center member 31, a back insertion hole 31*a* having substantially the same diameter as the collector core 41 is provided at the rear end of the center member 31, and a center insertion hole 31*b* and a tip insertion hole 31*c* having substantially the same diameter as the ink supply core 50 are provided from the center toward the leading end of the center member 31.

Moreover, a ring shaped center member flange 31*e* is formed on the outer periphery of the center member 31, in the vicinity of the rear end of the center insertion hole 31*b* of the center member 31, and positioned further toward the front than the leading end of the surrounding member 32. The outer periphery of the center member 31 is configured from: a rear circular columnar rear section 31*d* provided at a position from a rear end of the center member 31 up to the center member flange 31*e*; a rear circular columnar front section 31*f* positioned from the center member flange 31*e* up to the vicinity of a leading end of the center insertion hole 31*b*; a central circular columnar section 31*g* positioned from a leading end of the rear circular columnar front section 31*f* up to slightly further to the front than the leading end of the center insertion hole 31*b*; and a front circular columnar section 31*h* positioned from a leading end of the central circular columnar section 31*g* up to the leading end of the center member 31.

Note that the outer diameters of the rear circular columnar rear section 31*d* and the rear circular columnar front section 31*f* are substantially the same diameter as the inner diameter of a leading end portion of the collector 40, and the outer diameter of the central circular columnar section 31*g* is substantially the same diameter as the diameter of the tip shaft front reduced diameter hole 16*a*. Moreover, the outer diameter of the front circular columnar section 31*h* is substantially the same as the diameter of a rear insertion hole 24 provided in the rear of the outer member 20, illustrated in FIG. 2.

Surrounding Member 32

The inner diameter of the surrounding member 32 illustrated in FIG. 3 is substantially the same diameter as the outer diameter of the leading end portion of the collector 40. Moreover, as illustrated in FIG. 3C, a surrounding member wide diameter portion 32*a* is provided with slightly widened diameter at the inner periphery of the surrounding member 32 at a position at a rear end of the surrounding member 32. A surrounding member inner projection 32*b* formed in a ring shape is provided at the inner periphery of the surrounding member 32 at a position approximately halfway from the rear end of the surrounding member 32. The surrounding member inner projection 32*b* is provided to clamp the leading end portion of the collector 40, using the surrounding member 32 and the center member 31.

Moreover, the outer periphery of the surrounding member 32 is configured from a surrounding member rear outer peripheral portion 32*c* at a position between the rear end of the surrounding member 32 and the surrounding member inner projection 32*b*, a surrounding member central outer peripheral portion 32*d* contiguous to the surrounding member rear outer peripheral portion 32*c*, and a surrounding member front outer peripheral portion 32*e* contiguous to the surrounding member central outer peripheral portion 32*d* at a position up to a leading end of the surrounding member 32.

A ring shaped surrounding member outer projection 32*f* is provided at a position approximately halfway back from a leading end of the surrounding member front outer peripheral portion 32*e*. A cutout, not illustrated in the drawings, is provided at the surrounding member outer projection 32*f* at at least one location in the circumferential direction. The outer diameter of the cutout is the same as the outer diameter of the surrounding member front outer peripheral portion 32*e*.

Interposing Member 33

As illustrated in FIG. 3C, the interposing member 33 is configured from an interposing member rear circular columnar section 33*a* with a substantially cylindrical tube shape covering the surrounding member 32 and having substantially the same outer diameter as the diameter of the surrounding member outer projection 32*f*, a coupling section 33*b* that is contiguously provided to the interposing member rear circular columnar section 33*a*, that covers as far as the center member flange 31*e*, and that has a substantially conical shape, and an interposing member front conical section 33*c* that is contiguously provided to the coupling section 33*b*, and that is formed in a gently-sloping conical shape covering as far as the vicinity of a leading end of the central circular columnar section 31*g*.

The interposing member rear circular columnar section 33*a* is interposed between a rear end of the surrounding member front outer peripheral portion 32*e* and the cutout of the surrounding member 32, and covers as far as the leading end of the surrounding member front outer peripheral portion 32*e*. As a result, the interposing member rear circular columnar section 33*a* engages with the surrounding member outer projection 32*f*.

Note that the inner periphery of the interposing member 33 is formed so as to follow the outer peripheries of the center member 31 and the surrounding member 32, and an inner diameter of the rear end side of the coupling section 33*b* is the same as the inner diameter of the surrounding member 32. Moreover, the inner diameter of the front end side of the coupling section 33*b* has a tapered shape gradually decreasing so as to transition from the inner diameter of the interposing member 33 to the outer diameter of the center member flange 31*e*.

Two Color Molding

The joint 30 is a component molded by two-color molding. The center member 31 and the surrounding member 32 are molded by primary molding, and the interposing member 33 is integrally molded onto the center member 31 and the surrounding member 32 by secondary molding. The interposing member 33 is provided with flexibility due to being formed from an elastic resin material at the coupling section 33*b*.

A thermoplastic elastomer is preferably employed as the elastic resin material in order to perform a molding process using a mold at high temperature. The material of the center member 31 and the surrounding member 32 configuring a primary molded body is preferably a hard resin, such as a PBT resin.

Outer Member 20

As illustrated in FIG. 2, the outer member 20 is configured from a cylindrical tube shaped outer member fixing portion 21, and an outer member taper portion 22 that is contiguously provided to the outer member fixing portion 21 and has a substantially circular conical shape. A beveled outer member tip portion 23 is provided at the leading end of the outer member taper portion 22.

A hole is formed through from a rear end toward the leading end of the outer member 20. Specifically, the rear insertion hole 24 is provided along the inner periphery of the outer member fixing portion 21, and a front insertion hole 25 of smaller diameter than the rear insertion hole 24 is provided along the inner periphery of the outer member taper portion 22 in the vicinity of its leading end.

The outer member fixing portion 21 is fixed to the tip shaft 11 by fitting into the outer member insertion hole 16*b*. The outer member 20 covers the ink supply core 50. Simultaneously, the front circular columnar section 31*h* (see FIG. 3B and FIG. 3C) of the joint 30 is inserted into the rear insertion hole 24, and the ink supply core 50 projecting out from the joint 30 is inserted into the front insertion hole 25.

Ink Supply Core 50

The ink supply core 50 illustrated in FIG. 2 is molded by extrusion molding a resin material such as polyacetal. During extrusion molding, a path is formed that guides ink to the tip of the ink supply core 50 by capillary action.

Note that during extrusion molding, the ink guiding path mentioned above may be configured by forming gaps exhibiting capillary force inside the ink supply core 50, or by forming gaps exhibiting capillary force at the outside of the ink supply core 50. Moreover, the ink supply core 50 may be a fiber core, a sintered core, or the like.

Characteristics of the Writing Implement 1

In the writing implement 1 according to the exemplary embodiment of the present invention, the joint 30 is configured from three members. The joint 30 has a characteristic structure in which, even though the surrounding member 32 and the center member 31 are the same primary molded body, they are not continuous to each other in the primary molded body. The interposing member 33 accordingly deforms in the vicinity of the coupling section 33*b*, such that the joint 30 flexes readily.

Figure 4:
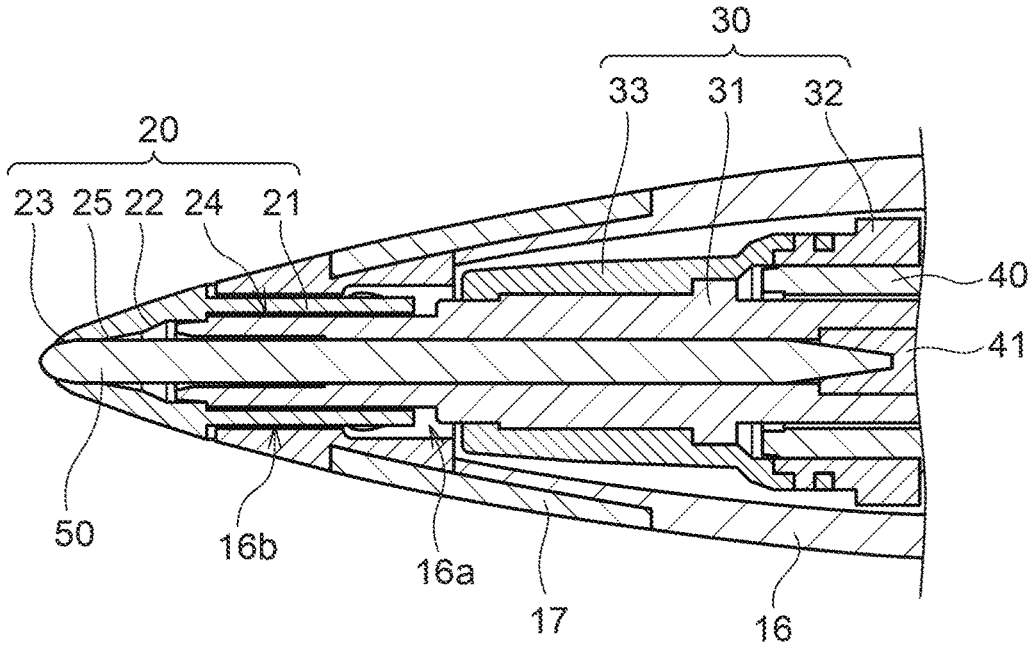
FIG. 4 is an enlarged cross-section of a front side of a writing implement according to an exemplary embodiment of the present invention, when in a retracted position.

Accordingly, as illustrated in FIG. 4, a relative positional relationship between the ink supply core 50 and the outer member 20 is displaced due to the joint 30 flexing under writing pressure, thereby enabling the ink supply core 50 to move toward a retracted position.

On the other hand, as illustrated in FIG. 2, when the writing load is reduced and the writing pressure applied to the ink supply core 50 becomes lighter, the joint 30 returns from the flexed shape to its initial shape under elastic action, accompanying which the ink supply core 50 also returns to a projecting position.

Note that when the ink supply core 50 is moved to the retracted position under writing pressure, and writing is started with the tip of the ink supply core 50 and the tip of the outer member 20 both in contact with the writing surface at the same time, the ink held by the ink supply core 50 flows out accompanying the writing. Then, the ink that has flowed out spreads due to capillary action between the tip of the ink supply core 50 and the tip of the outer member 20 that are in contact with the writing surface. As a result, a broader line can be drawn than when writing in a state in which only the tip of the ink supply core 50 is in contact with the writing surface.

Moreover, when the ink supply core 50 is moved to the retracted position under writing pressure, and writing is performed with the tip of the ink supply core 50 and the tip of the outer member 20 in contact with the writing surface at the same time, the writing pressure applied when writing is borne mainly by the outer member 20, enabling the writing pressure placed on the ink supply core 50 that holds the ink to be reduced. This thereby enables wear of the pen tip of the ink supply core 50 to be reduced. Moreover, the ink supply core 50 is covered by the outer member 20, such that even if the pen tip is knocked or receives a shock from being dropped, the ink supply core 50 does not suffer damage that renders it incapable of writing. Moreover, unlike the ink supply core, the core surrounding member does not have holes in its surface, thereby reducing catching on the paper surface to give a smooth writing sensation.

Moreover, due to utilizing the elastic action of the joint 30, the ink supply core 50 moves forward from the retracted position toward the projecting position in a continuous action when the writing load is lightened by removing the writing section from the writing surface with an action that produces a "stop" or a "sweeping stroke". This thereby enables a continuous and smooth transition in the width of the writing, from a broad line to a thin line.

What is claimed is:

1. A writing implement comprising:

a shaft;

an ink supply core that is housed inside the shaft, and that is capable of guiding ink by capillary force;

a collector core in contact with a proximal end of the ink supply core;

a core surrounding member that covers an outer periphery of the ink supply core such that a portion of the ink supply core and a portion of the core surrounding member are exposed at a leading end of the shaft; and a joint that is capable of changing a relative positional relationship between the ink supply core and the core surrounding member in an axial direction, wherein the ink supply core is moved by elastic deformation of the joint, thereby causing the ink supply core to move relatively rearward with respect to the core surrounding member so as to enable a tip of the ink supply core and a tip of the core surrounding member to contact a writing surface at the same time.

2. The writing implement of claim 1, wherein:

the joint is an elastic member disposed at a rear of the ink supply core, and the relative positional relationship between the ink supply core and the core surrounding member can be changed by compression of the elastic member; and the ink supply core is formed so as to be able to move rearward relative to the core surrounding member, from an initial position that is a portion of the ink supply core exposed from the core surrounding member, by the elastic member being compressed with load applied to the tip of the ink supply core.

3. The writing implement of claim 2, wherein an ink supply space including a gap exhibiting capillary force is formed at an inside of the ink supply core, and ink is guided by the capillary force of the ink supply space.

4. The writing implement of claim 2, wherein an ink supply space including a gap exhibiting capillary force is formed at an outside of the ink supply core, and ink is guided by the capillary force of the ink supply space.

* * * * *